United States Patent [19]

Danziger

[11] 4,179,019

[45] Dec. 18, 1979

[54] APPARATUS FOR RECLAIMING USED LUBRICATING OILS

[76] Inventor: Harry L. Danziger, 21a Cork St., Old Bond St., London, England, W1X 1HB

[21] Appl. No.: 868,262

[22] Filed: Jan. 9, 1978

[51] Int. Cl.[2] ..... C10G 33/00; C10G 34/00; C10G 41/00

[52] U.S. Cl. ..... 196/46.1; 196/98; 196/114; 196/134; 208/179; 208/180; 208/182; 208/186

[58] Field of Search ..... 196/46.1, 98, 114, 134, 196/155; 208/179, 180, 182, 186

[56] References Cited

U.S. PATENT DOCUMENTS

| | | | |
|---|---|---|---|
| 1,962,463 | 6/1934 | Renfrew | 196/46.1 |
| 2,159,994 | 5/1939 | Brecque | 196/46.1 |
| 2,161,964 | 6/1939 | Brecque | 196/46.1 |
| 2,302,552 | 11/1942 | Johnson | 196/46.1 |
| 2,303,262 | 11/1942 | Dunmire | 196/46.1 |
| 2,425,377 | 8/1947 | Brecque | 196/46.1 |
| 2,622,229 | 1/1953 | Miller et al. | 196/46.1 |
| 3,366,551 | 1/1968 | Kaso | 196/46.1 |
| 3,879,264 | 4/1975 | Seelbach | 196/46.1 |
| 3,923,644 | 12/1975 | Hindman | 196/46.1 |

*Primary Examiner*—Morris O. Wolk
*Assistant Examiner*—Bradley R. Garris
*Attorney, Agent, or Firm*—Rose & Edell

[57] ABSTRACT

A used lubricating oil reclamation apparatus in which filters, heat exchangers, a vaporizer unit, pumps and other necessary equipment are all contained in a wheeled cabinet. The oil to be reclaimed is pumped through a warming heat exchanger, a first filter, a vaporizer unit, and further filters, after which appropriate additives are mixed into the decontaminated oil in a mixing tank. A vacuum is maintained on the vaporizer unit to exhaust the vapours from it via the heat exchanger and a condensate tank.

13 Claims, 3 Drawing Figures

APPARATUS FOR RECLAIMING USED LUBRICATING OILS

This invention relates to the processing of used lubricating oils for the purpose of reconditioning such oils for re-use.

Huge quantities of lubricating oils are continually being discarded after use, especially at automobile garages which have to dispose of large amounts of used sump oil from motor vehicles. Some of this oil is processed for re-use but for that purpose it has to be collected and sealed in drums and returned to an oil company where it is put through large-scale industrial oil-treatment plant. This gives the individual automobile service station or oil user very little incentive to save the oil. It is therefore an object of the invention to make the processing of lubricating oils for re-use a more widely practised activity.

According to the present invention, there is provided a lubricating oil treatment apparatus, comprising pumps, filters, heat exchange means and a vaporiser unit operating under vacuum, embodied in a self-contained movable module. By thus making it possible for individual service stations and oil users to possess their own units for treating the oil, the reconditioning of used oil becomes a considerably more attractive proposition.

One arrangement according to this invention will now be described by way of example and with reference to the accompanying drawings, in which.

While the apparatus to be described is mainly intended for treating used sump oil from motor vehicles, it can also be employed fro industrial lubricating oils.

Figure 3:
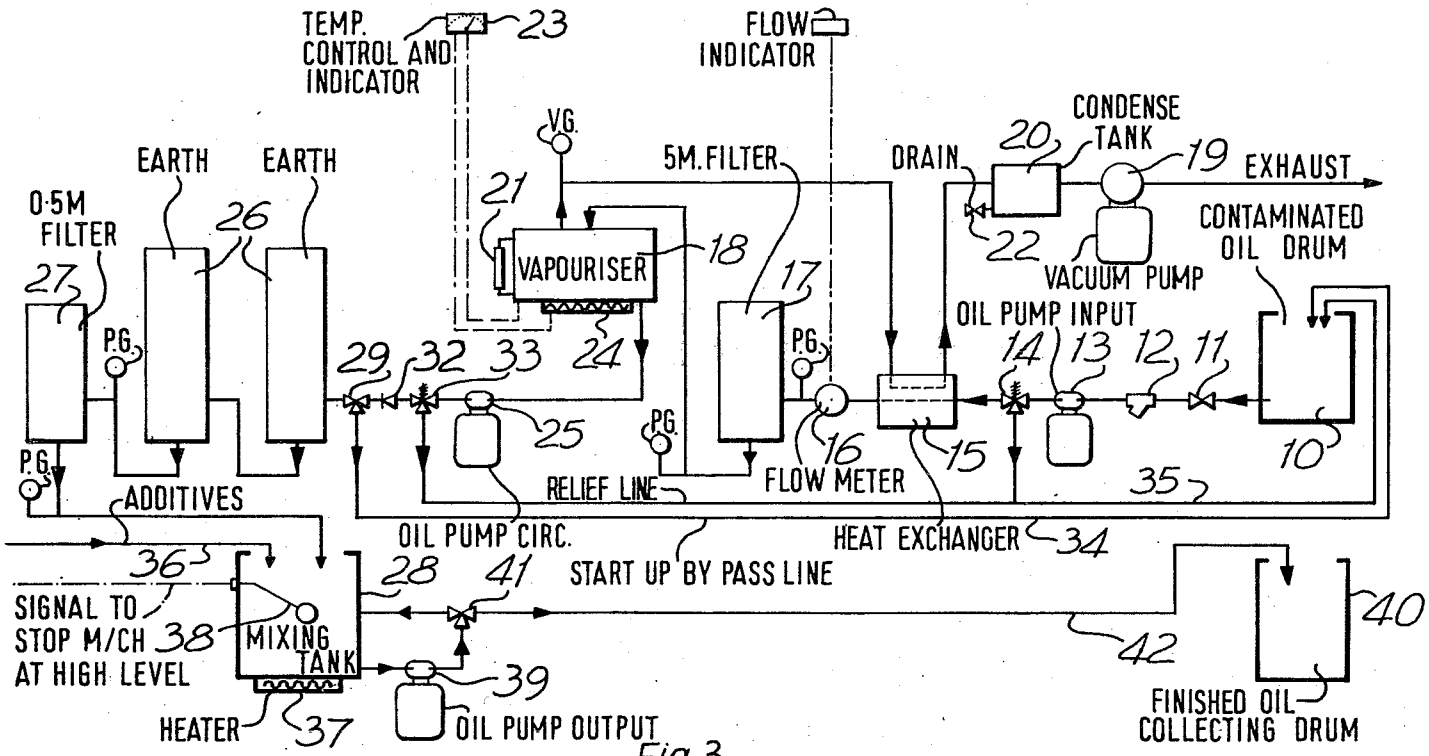
FIG. 3 shows the flow sheet of the apparatus.

Referring to FIG. 3, oil to be treated, e.g. from a drum 10 containing contaminated oil, is pumped into the apparatus through an inlet valve 11 via a 60 mesh Y-type strainer 12 by an oil input pump 13. The discharge of the pump passes through a relief valve 14 into a heat exchanger 15 where it is warmed by heat exchange with vapour drawn from the top of a vaporiser unit to be subsequently described. On leaving the heat exchanger 15, the oil passes through a flow meter 16 and then through a preliminary 5 micron filter 17 after which the warmed oil enters the vaporiser unit 18.

In the vaporiser unit 18, the oil is heated to a temperature to drive off water and volatiles and this operation is assisted by a vacuum pump 19 which pulls a vacuum on both the vaporiser unit and an associated condensate tank 20. The vapours drawn off from the vaporiser unit 18, after passing through the aforementioned heat exchanger 15 to warm the incoming oil, enter the condensate tank 20 where condensate settles out, and are then exhausted through the vacuum pump 19. The condensate tank may be provided with a sight level gauge to assist an operator in determining when, periodically, the vacuum should be released and the condensate drain 22 opened. Also, a level indicator may be fitted to trigger off an audible alarm if this service attention is neglected and the condensate level in the tank rises too high. The vaporiser unit 18 is equipped with an electric heater 24 having an associated temperature control and indicator instrument 23. The vaporiser also has a sight level gauge 21.

After leaving the vaporiser unit 18, the oil is pumped by a circulating pump 25 in succession through two earth filters 26 and a final 0.5 micron filter 27 before discharging into a tank 28. Between the circulating pump 25 and the first filter 26 the oil line includes a non-return valve 32, with a pressure relief valve 33 immediately upstream of the valve 32. Immediately downstream of the non-return valve 32, a changeover valve 29 enables the oil flow to be directed, at start-up, into by-pass line 34 instead of through the filters 26, 27. The oil bypass line 34, and also the relief line 35 for the pressure relief valves 14 and 33, deliver back into the oil drum 10 from which the oil to be processed is drawn.

The tank 28 is a mixing tank in which oil additives supplied through a line 36 are mixed with the decontaminated oil from the filters. A heater 37 heats the oil in the tank 28, and a float valve 38 supplies a signal to stop the apparatus from delivering oil into the tank 28 when the level in the tank rises to a predetermined high level. An output pump 39 pumps the finally treated oil from the mixing tank 28 into a collecting drum 40; a changeover valve 41 enables the output of the pump 39 to be returned to the tank 28 for mixing instead of being discharged through the output line 42.

Figure 1:
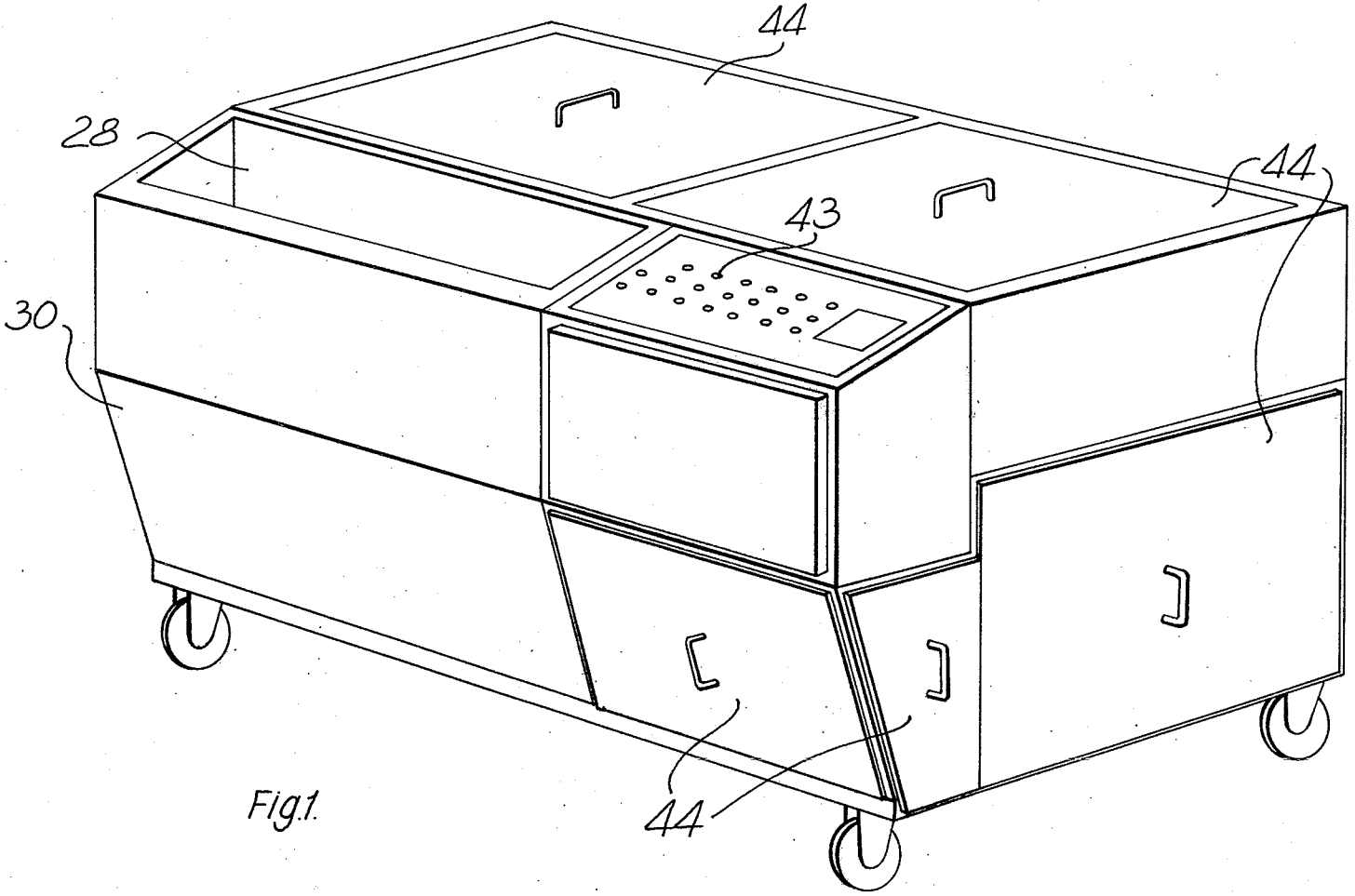
FIG. 1 is a front pictorial external view of the apparatus to be described.
Figure 2:
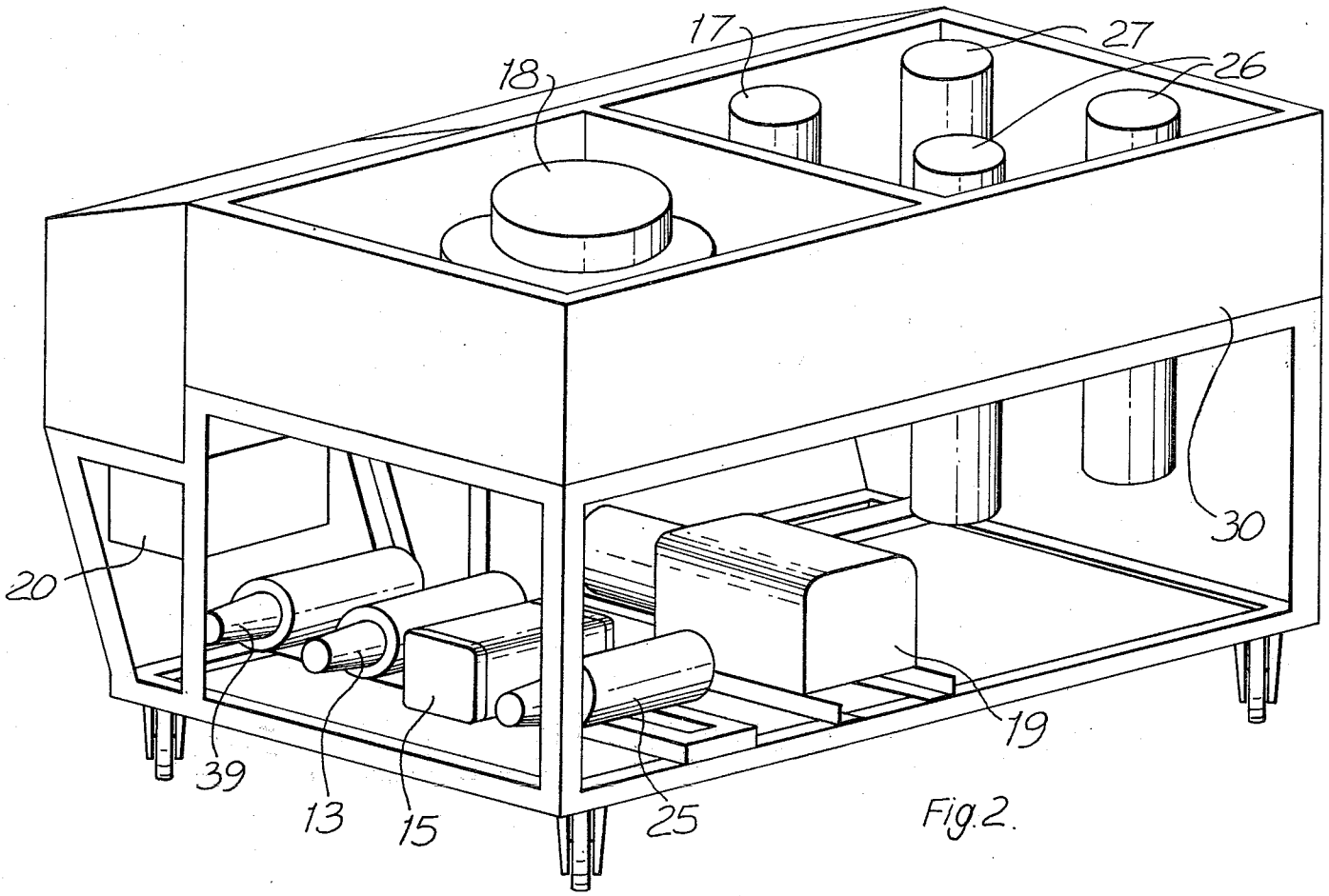
FIG. 2 is a rear pictorial view with the covers removed.

Referring now to FIGS. 1 and 2, the apparatus is housed in a wheeled cabinet 30 with a console display of indicator lamps and gauge readings. Instruments are provided to display the following: oil reading measured at the flow meter 16; pressure differential across the filter 17; pressure differential across the filter 27; temperature of the oil in the vaporiser unit; vacuum gauge reading. Control of the apparatus is by means of a push button control panel 43. The cabinet 30 forms a self-contained portable module, and removable panels 44 give ready access to the various units of the plant.

I claim:

1. Apparatus for reclaiming used lubricating oil on a continuous flow basis, comprising an inlet line for oil to be reclaimed, a first filter unit receiving oil from said inlet line, inlet pump means for pumping oil through said inlet line and said filter unit, a vaporizer unit receiving the oil after passage through said filter unit and wherein the oil is heated to drive off water and volatiles, further filter means including a plurality of earth filters, circulating pump means for pumping the oil from said vaporizer unit through said earth filters in succession, and additive adding means for adding additives to the oil after passage through said further filter means.

2. Apparatus according to claim 1, further comprising a heat exchange unit arranged and constructed for warming the incoming oil with vapour being exhausted from the vaporiser unit.

3. Apparatus according to claim 2, comprising a vacuum pump drawing vapour from the vaporiser unit through said heat exchange unit, and a condensate tank upstream of the vacuum pump.

4. Apparatus according to claim 1, wherein said first filter unit is a 5 micron filter and said further filter means include a 0.5 micron filter.

5. Apparatus according to claim 4, comprising gauge means for indicating the pressure drops across the 5 micron and 0.5 micron filters.

6. Apparatus according to claim 2, comprising a pressure relief valve in the oil line between said inlet pump means and said heat exchange unit.

7. Apparatus according to claim 1, comprising a pressure relief valve in the oil line between said circulating pump means and said further filter means.

8. Apparatus according to claim 7, comprising a changeover valve and bypass line whereby oil discharged by the circulating pump means can be bypassed back to the source of oil to be reclaimed without passing through said further filter means.

9. Apparatus according to claim 1, wherein said additive adding means comprises a mixing tank in which oil leaving said further filter means is collected and mixed with additives before being passed out as finished oil for re-use.

10. Apparatus according to claim 9, comprising an output pump and changeover valve operable either to recirculate oil through the mixing tank or to discharge finished oil from the mixing tank to a finished oil outlet.

11. Apparatus according to claim 9 or claim 10, wherein the mixing tank has a heater.

12. Apparatus according to claim 1, all contained in a wheeled cabinet.

13. Apparatus according to claim 12, wherein the cabinet is provided with removable access panels and a push button control console.

* * * * *